US007086589B2

(12) United States Patent
Rudduck

(10) Patent No.: US 7,086,589 B2
(45) Date of Patent: Aug. 8, 2006

(54) SMART CONNECTIONS

(75) Inventor: Dickory Rudduck, Seaforth (AU)

(73) Assignee: Telezygology Inc., Milsons Point (AU)

( * ) Notice: Subject to any disclaimer, the term of this patent is extended or adjusted under 35 U.S.C. 154(b) by 0 days.

(21) Appl. No.: 10/243,983

(22) Filed: Sep. 13, 2002

(65) Prior Publication Data

US 2003/0075603 A1 Apr. 24, 2003

Related U.S. Application Data

(63) Continuation of application No. PCT/AU01/00285, filed on Mar. 15, 2001.

(30) Foreign Application Priority Data

Mar. 15, 2000 (AU) ..... PQ6234

(51) Int. Cl.
*G06F 7/08* (2006.01)

(52) U.S. Cl. ..... 235/381; 235/383

(58) Field of Classification Search ..... 235/381, 235/382, 383; 700/231, 232, 233
See application file for complete search history.

(56) References Cited

U.S. PATENT DOCUMENTS

| | | | | |
|---|---|---|---|---|
| 4,033,442 | A * | 7/1977 | Wirstlin et al. | 194/225 |
| 4,866,661 | A | 9/1989 | de Prins | |
| 5,088,586 | A * | 2/1992 | Isobe et al. | 194/205 |
| 5,722,526 | A | 3/1998 | Sharrard | |
| 5,730,316 | A * | 3/1998 | Falk | 221/122 |

(Continued)

FOREIGN PATENT DOCUMENTS

| | | |
|---|---|---|
| DE | 29511239 | 8/1996 |

(Continued)

OTHER PUBLICATIONS http://www.unisen.com/sensorsmainpage.html—UNISEN™—Tag Deactivators.

*Primary Examiner*—Ahshik Kim
(74) *Attorney, Agent, or Firm*—Wilmer Cutler Pickering Hale & Dorr LLP

(57) ABSTRACT

The invention provides a method of controlling access to an object (16), such as a product for sale. The object (16) or its packaging (110) is secured, for example to a sales console (12,68) by use of connecting means (26). The connecting means (26) are either capable of release by a chosen external or internal signal or capable of release by activating remote activating means (18). An internal signal may be provided after expiration of a predetermined period. An external signal may be provided by proximity. Remote activation means (18) may be provided by a password or energy such as a magnetic force. The invention also provides novel packaging (110) for an object (16). Packaging (110) is adapted to secure the object (16) by connecting means (26) capable of release by remote activation. Also provided is a security vending system having security vending means, such as a sale console (68) or a cable (48) or a sale hanger (108). The security system also has connecting means (72, 74) capable of release by a chosen internal or external signal or by remote activation. The connecting means (72, 74) may have an intelligent element (94), which may reside in the security means, in the object (16), or partly in one and partly in the other.

50 Claims, 18 Drawing Sheets

U.S. PATENT DOCUMENTS 5,785,181 A * 7/1998 Quartararo, Jr. ..... 209/3.3
5,850,442 A 12/1998 Muftic
5,890,520 A * 4/1999 Johnson, Jr. ..... 141/94
5,917,407 A 6/1999 Squire et al.
5,936,544 A * 8/1999 Gonzales et al. ..... 340/5.22
6,038,492 A * 3/2000 Nichols et al. ..... 700/232
6,038,551 A 3/2000 Barlow et al.
6,198,391 B1 * 3/2001 DeVolpi ..... 340/568.2
6,233,327 B1 * 5/2001 Petite ..... 379/155
6,264,104 B1 * 7/2001 Jenkins et al. ..... 235/383
6,397,126 B1 * 5/2002 Nelson ..... 700/236
6,742,673 B1 * 6/2004 Credle et al. ..... 221/88

FOREIGN PATENT DOCUMENTS

EP 0 811 958 12/1997
WO WO 90/06565 6/1990
WO WO 99/47819 9/1999

* cited by examiner

FIGURE 2
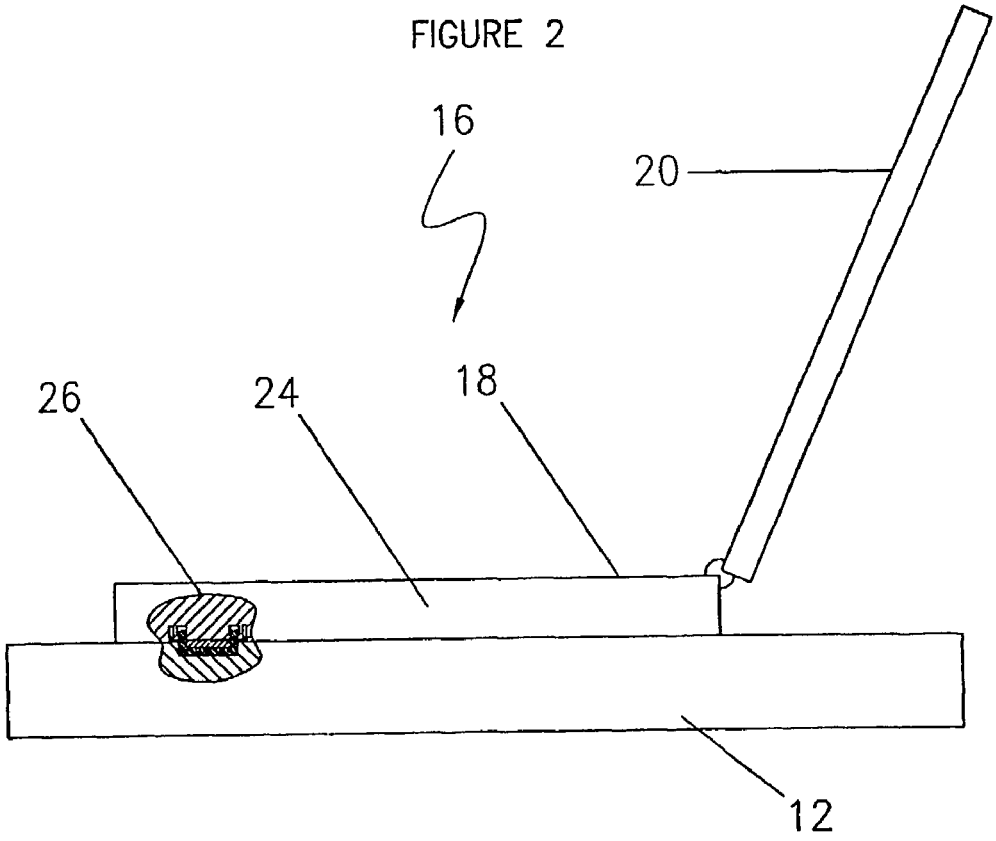
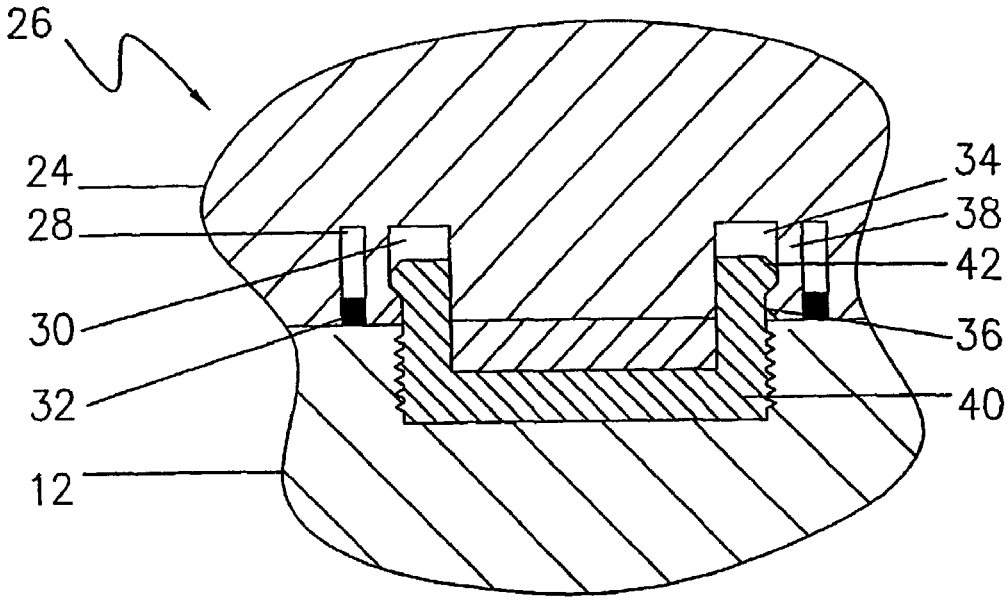
FIGURE 2A

FIGURE 3
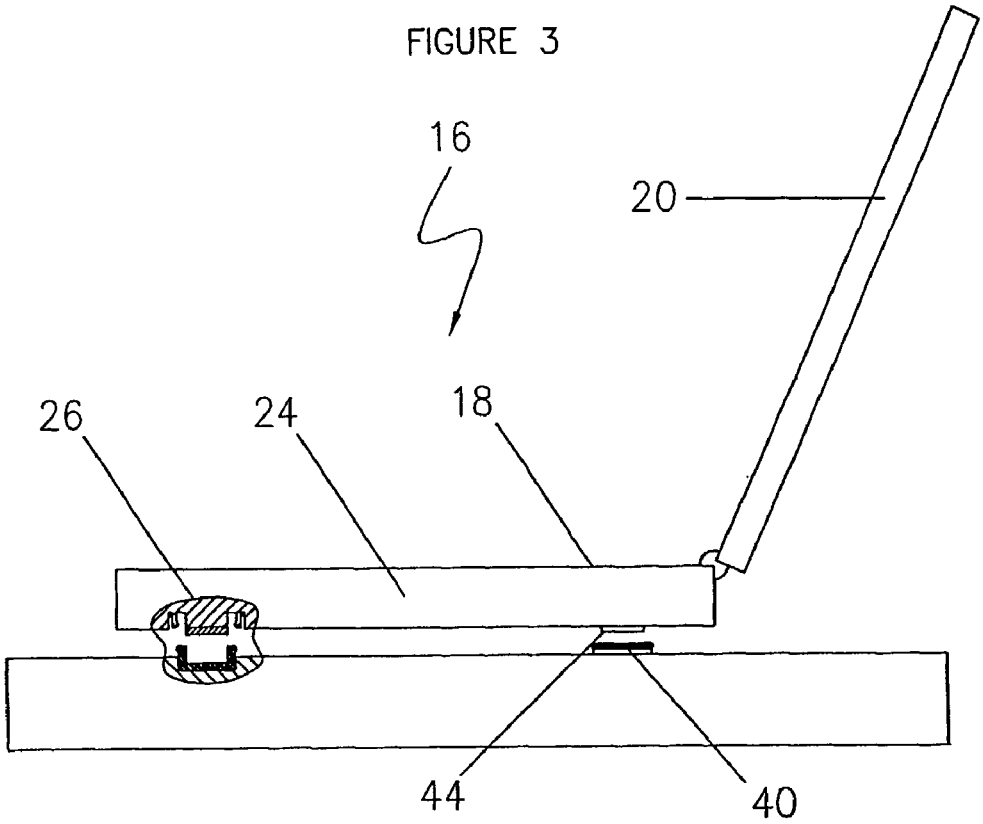
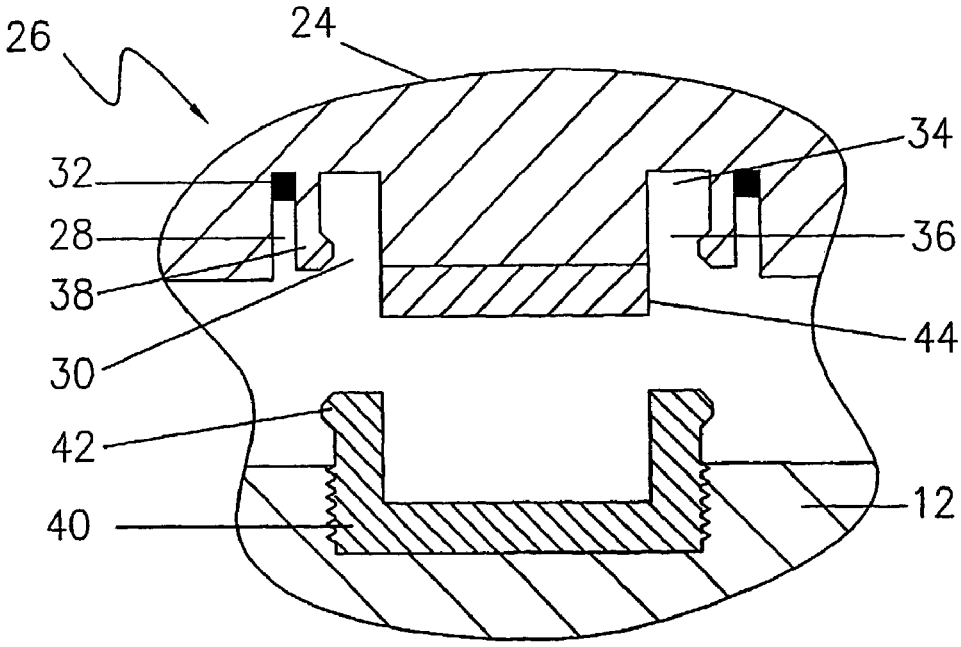
FIGURE 3A

SMART CONNECTIONS

CROSS REFERENCE TO RELATED APPLICATIONS

This application is a continuation of International Patent Application Serial Number PCT/AU01/00285, filed Mar. 15, 2001, which claims priority to Australian Patent Application Number PQ6234, which was filed on Mar. 15, 2000. The contents of International Patent Application Serial Number PCT/AU01/00285 and Australian Patent Application Number PQ6234 are incorporated herein by reference.

TECHNICAL FIELD

This invention relates to novel forms of packaging, to new methods of packaging and connecting objects, to novel merchandising systems and to methods of controlling access to an object.

BACKGROUND ART

International patent application No. PCT/AU99/00185, published as WO99/47819, disclosed a new method of fixing or releasing a first element and a second element, by remote activation. That specification also disclosed a new form of connecting means adapted to fix or release a first element and a second element. The connecting means included a locking means moveable by remote activation between a locked position and an unlocked position.

The disclosure in International patent application No. PCT/AU99/00185 is imported herein by reference.

The present invention represents a development of the invention disclosed in No. PCT/AU99/00185 and represents a significant advance in traditional merchandising and security procedures.

In conventional retailing, products for sale are commonly displayed in one of two ways. In the first case, a large number of products is displayed together, for example in a supermarket environment. In this case, the purchaser selects desired products from the shelves or bins in the supermarket, has the products processed by a cashier, pays the purchase price and leaves with the products. In some cases, there are store consultants whom the purchaser may consult before selecting any product.

In the second case, products are displayed, often singly or in low numbers, in display areas or enclosed in display cabinets. This is commonly the preferred method for displaying products of significant value for sale. Sales personnel are generally close at hand to assist a purchaser in selecting a product. Often the same sales personnel process payment for the product by the purchaser.

Especially in the case of products of significant value, these are often locked in display cases. If a prospective customer wishes to have a closer look at a product, it is necessary for sales personnel to find the keys for the display cabinet, unlock the display cabinet, return the product to the display cabinet if it is not purchased and re-lock the display cabinet. This is time consuming and inconvenient.

The cost of providing sales consultants, cashiers and sales personnel is significant and it is desirable to minimise that cost factor if possible.

DISCLOSURE OF THE INVENTION

It is an object of the present invention, in one version, to provide a method of controlling access to an object or thing.

It is an aim of the present invention, at least in some embodiments, to provide a merchandising system which substantially reduces the need for sales assistants, sales personnel or cashiers.

In one embodiment, it is an object of the present invention to provide a merchandising system with an inbuilt "wrapping" facility at the purchase point.

In another embodiment, it is an object of the present invention to provide a merchandising system which provides an object in a package restricted to opening at a prescribed time or after some other prescribed trigger, such as a command.

In yet another embodiment of the invention, it is an object to provide product packaging which can enable tracking of the packaging via global positioning system technology.

Accordingly, this invention provides, in one aspect, a method of controlling access to an object, the method including the steps of securing the object or its packaging by use of connecting means which connect the object or its packaging to a security means, the connecting means being capable of release by a chosen external or internal signal upon provision of a trigger; and releasing the connecting means by providing the chosen signal upon provision of the trigger; characterized in that the trigger is chosen from the group consisting of a predetermined period of time or calendar date, location of the object or its packaging and proximity of the object to an authorized item.

In another aspect, this invention provides a method of vending an object, the method including the steps of:

- securing the object or its packaging by use of connecting means which connect the object or its packaging to a security means, the connecting means being capable of release by remote activation;
- accepting an offer to purchase the object; and
- releasing the connecting means by activating remote activation means.

The object in these aspects of the invention may be chosen from a wide variety of different types of things, preferably of high value. While the use of the method in connection with vending high value objects may be of particular interest, the invention is not necessarily limited to this type of product.

The object may be secured directly or via one or more packaging elements. In the case of securing an object in a single pachaging element, the object is preferably completely enclosed by that element. For example, the element may be secured to itself along its edges, enclosing the object.

In many situations, however, there will be two or more packaging elements which fit together to secure the object. Once again, it is preferred that these packaging elements completely envelope the object.

The object, or the packaging element or elements secured around the object, are capable of release by remote activation. Such means may be, for example, those disclosed in International patent application No. PCT/AU99/00 185. Other connecting means capable of release by remote activation may also be suitable.

The object, or the packaging element or elements secured around the object, are capable of release by remote activation. Such means may be, for example, those disclosed in International patent application No. PCTAU/99/00185. Other connecting means capable of release by remote activation may also be suitable.

Preferably, the connecting means includes a locking means movable between a locked position and an unlocked position, the locking means being disposed in a passageway with walls at least one of which is resilient, the locking means being adapted to hold apart the walls when the locking means is in the locked position and to permit deflection of at least one of the walls when in the unlocked position.

In the methods of the invention, where packaging is present, it is not necessary that the packaging element or elements alone secure the object. The packaging element or elements may be used to secure the object by locking the object and/or the packaging elements to a base plate or other secure location.

In the method of vending the object according to the invention, the connecting means are released after acceptance of an offer to purchase the object. The offer to purchase may be received in any suitable way. By way of example, the offer to purchase may be conveyed by telephone, even by mobile telephone. The offer to purchase may be accompanied by authorisation to debit the purchase price of the product to a particular credit or debit card. Another example of the way in which an offer can be conveyed is via the Internet. Other suitable systems will no doubt be developed over the next decade or two and these may be equally applicable to the method of the invention and are within its scope.

The connecting means securing the object may be released by any suitable remote activation means. The remote activation means chosen will depend to a large extent on the nature of the connecting means. Some examples are given in International patent application No. PCT/AU99/00185 and some of those may be used in connection with the present invention.

Other examples are set out below.

The remote activation means may involve the use of a password sent to the purchaser by fax, phone, Internet, mail or any other suitable way. As another example, an electronic signal may be sent (such as by telephone, radio or other means) to the connecting means to effect release of the connecting means.

It will be appreciated by one skilled in the art that the methods of the invention can revolutionise the art of retailing. For example, shops, even large chains of shops in various locations throughout the world, may be operated without any onsite personnel. Objects to be sold may be displayed in secured packaging according to the invention. Objects may be displayed without packaging while still being secured. A limited number of sales enablers may be available by telephone. Such sales enablers may be located in a centralised position, which may be remote from the sites of the stores. A prospective purchaser can make telephone contact with a sales enabler who can answer the purchaser's questions about any particular object, and, if the sale is to proceed, accept the purchaser's offer to purchase the object, process payment to the purchasers credit or debit card, and activate the remote activation means, enabling the purchaser to take away the object purchased.

The need for a sales assistant to be present on site to lock and unlock display cabinets containing products is eliminated. On the other hand, if it is desired to have one or more sales personnel on site, their task is greatly alleviated by the method of the invention. In particular, once a sales assistant has processed the purchase of a product, the sales assistant can release the product or its packaging by using the remote activation means, for example, by simply pointing remote activation means at the product and providing the required signal by "clicking" an appropriate button.

While product information may be available from sales enablers as discussed above, this is not essential to the operation of the methods of the invention. For example, product or other information may be available from the object itself or its packaging or surrounding environment. An instance of how this might occur may involve the provision of means for detecting the proximity of a person being a potential purchaser. The detection of proximity of a person may immediately cause an audio, visual or audio/visual message to be provided. Alternately, the message may be provided only if the person detected is over a chosen height (if the product is not directed to children) or if the person lingers in the area for a chosen time. More primitively, a prospective purchaser may be invited to trigger the message by touch, for example. The message may be triggered by an olfactory stimulus, such as when a prospective purchaser opens a sample of perfume or food. The message may also be triggered by audio or visual stimulus.

The information provided in this embodiment may be static or may change, for example, in a chosen cycle. It may be triggered as exemplified above. It may be provided interactively, with the prospective purchaser selecting options as from a menu, or via spoken or electronic dialogue.

As may be appreciated from the discussion in connection with the drawings, below, there are many ways in which the methods of the invention can be implemented. For example, the "intelligence" which controls the access to an object or which permits the connecting means to be released, as well as other "intelligence" enabling options such as "wrapping" (discussed in more detail below) may reside in the object. This is particularly convenient where the object is a computer, for example. As another example, the "intelligence" may reside in something to which the object is connected, such as a sales console or a security cable. The arrangement can be somewhere between these two extremes, with some of the "intelligence" in the object and some of the "intelligence" elsewhere.

Moreover, the methods of the invention can operate in a sales environment by requiring a potential purchaser to pre-register in a suitable way. For example, if a potential purchaser wishes to closely inspect and handle an object, he may first be required to "swipe" a credit or debit card which may then be immediately debited with the price of the object. The purchaser can then inspect and handle the object. If the purchaser decides not to purchase the object, provided the object is returned to its original position within a predetermined period of time, the previous debit is reversed. In this embodiment, the swiping of the credit or debit card provides the external signal to the connecting means to release the object for inspection and handling.

In another aspect, this invention provides a security vending system for carrying out the methods of the invention. The system of the invention includes a security means as well as the connecting means which are either capable of release by a chosen external or internal signal or capable of release by remote activation. The security means may be a sales console which can secure one or many objects. The security means may also be a security cable or sales hanger, for example.

The connecting means may have different elements, one of which may be an intelligent element adapted to receive the chosen signal or be activated by the remote activation means. The intelligent element may reside in the security means, in the object or its packaging, or partly in the security means and partly in the object or its packaging.

There are several optional features which can be combined with the methods of the invention or used independently. Some of these are discussed below. The invention includes these features used independently of the methods, and packaging which includes any of these features.

The first optional feature can be useful if the purchaser is obtaining the object as a gift for a third person. Frequently, the packaging elements will be transparent, at least partially, so that a prospective purchaser can view the object through the packaging element. In the case where the object is secured to a base and released from that base at the time of purchase, the packaging elements can act as packaging for the object, presenting it in a desirable way and helping to protect it from damage during transport. In the case where the object is intended as a gift, the vending method may include the step of obscuring the object from viewing outside the packaging elements.

There are many ways in which this step can take place. By way of non-limiting example, the packaging elements may comprise or include transparent material which can be rendered opaque by application of an electric current, for example. As another example, the packaging elements may form a dome which includes a confined element which can open, rather like a parachute, within the dome to cover the object from view.

Preferably, when the object is obscured from view, it is done in a decorative way, so that the packaging appears to incorporate gift wrapping, or an appropriate message. For example, in the case of transparent material rendered opaque, the opacity can resemble gift wrap, and/or carry a greeting such as "Happy Birthday". Similarly, in the case of a confined element which expands, a gift wrap pattern and/or a greeting may be visible on the expanded confined element.

As well as causing the transparent material to be rendered opaque, it can be caused to darken or to fluoresce, by way of obscuring the object from view. In another embodiment, the transparent material may be capable of exhibiting a dynamic display, either for decorative or information purposes. For example, the transparent material may take the form of a three dimensional plastic screen onto which information can be projected or onto which decorative material can be projected.

Another option involves a delay in releasing the connecting means, either in connecting the packaging elements about the object or securing the object to a base. This feature can have many uses. Some examples will now be given. The object may be purchased as a gift for a birthday or other celebration. The connecting means, securing the packaging elements around the object, may be instructed to release only on a chosen date, such as that of the birthday. Another example arises when the connecting means are instructed to release only after they have been given a programmed command. The command may take any form, including electronic, but most conveniently is aural. Thus the purchaser may choose, at the time of purchase, a verbal command which can enhance the surprise value of the gift.

The invention also provides a novel packaging for an object, the packaging including:

one or more packaging elements; and connecting means adapted to secure the object in the packaging element or elements, the connecting means being capable of release by remote activation.

The packaging of the invention may incorporate any of the features described above in connection with the method of the invention. Any of these features may be used independently of the method of the invention, in addition.

The packaging of the invention may also incorporate means for allowing the packaging (and the object) to be tracked via global positioning system technology, such as global positioning by satellite. This can be useful in many ways. One is to locate the object in the case of theft. Another is to provide a service to the purchaser in the case of loss of the object while still in the packaging. Still another is to provide real market demographic data through tracking the location of the object while still in the packaging.

On the subject of theft, the packaging of the invention may also include alarm activation means, designed to cause an alarm to be activated if an attempt is made to remove the packaging beyond a chosen site (such as shop premises or an airport terminal) without authorisation. In this case, when the object in the packaging of the invention is purchased with authorisation, the alarm activation means in the packaging may be neutralised.

Optionally, the packaging of the invention may include illumination means, preferably internally. This can assist in presentation of the object in the packaging.

The method of the invention, for controlling access to an object, may be used to indicate expiration of shelf life of an object or product. In this case, the chosen signal may be an internal signal provided after expiration of a predetermined period (or attainment of a predetermined date). The signal can cause release of connecting means securing the object or product in its packaging.

The method in this aspect of the invention can have particular application for objects where it is important to know that the effective life of the object or its shelf life has expired. An example is perishable foodstuffs which can create a health threat after the shelf life has expired. Another example is a pharmaceutical object, the effectiveness of which changes with the expiration of its shelf life. If the connecting means are programmed to release at the "use by" date, simple inspection can show whether the object, such as a drug, is unsafe for use. If the packaging is open, then the drug should not be used. The same method can be applied to a vast range of objects, for various different purposes.

In another aspect, the connecting means may be programmed to release on a selected birthday or anniversary.

The method of the invention can be useful to limit access to, for example, aeronautical parts. In this example, the signal can be emitted by an authorised service manual within a chosen proximity to the connecting means. This can prevent tampering with aeronautical parts by unauthorised persons.

Similar purposes can be the prevention of unauthorised access to dangerous chemicals, or to evidence in criminal proceedings, to help establish a "chain of custody".

In another aspect, the signal may be provided when the object or its packaging is within a chosen location or outside a chosen area. The selected signal may include a signal from a global positioning system, to ensure that the packaging can be opened in a safe, secure, hygienic or authorised locality. Thus, goods which are not permitted for use or access in one country, for example, can be secured in their packaging until the goods have left that country.

The packaging of the invention or the object itself may include means adapted to provide information about the object. Such means are preferably activated by, for example, proximity of a purchaser or a positive action provided by the purchaser, such as touch. In even more sophisticated versions, the packaging or the object can conduct dialogue with a prospective purchaser, technical modules including a speaker provided for this purpose.

The invention also provides suitable packaging for the various aspects of the methods of the invention.

BRIEF DESCRIPTION OF THE DRAWINGS

The invention will now be illustrated by certain non-limiting example, described in connection with the drawings, in which:

FIG. 2 is a side elevation, partly broken-away, of the embodiment of FIG. 1;

FIG. 2A is an enlarged version of the broken-away portion of FIG. 2, showing detail of an embodiment of connecting means;

FIG. 3 is a side elevation, partly broken-away, of the embodiment in FIGS. 1 and 2, after release of the connecting means;

FIG. 3A is an enlarged view of the broken-away portion of FIG. 3, showing detail of the connecting means after release;

BEST MODES FOR CARRYING OUT THE INVENTION

Figure 1:
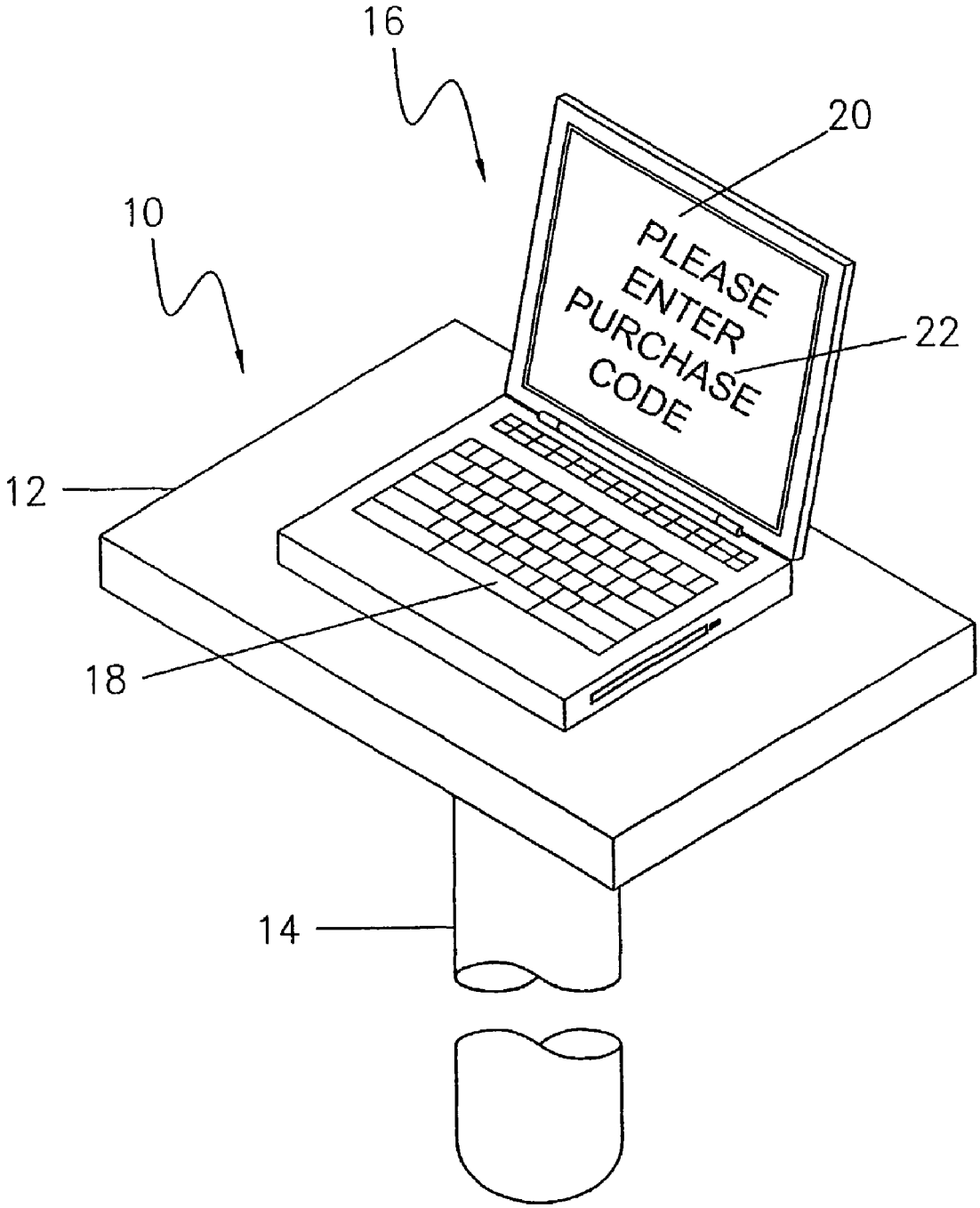
FIG. 1 is a perspective view of a display console illustrating a first embodiment of the method of the invention, having a lap-top computer connected to the console.

As shown in FIG. 1, display console indicated generally at 10 includes display table 12 and support 14 of suitable size. (For convenience, support 14 is omitted from FIG. 2 and also from FIG. 3.) Lap-top computer 16 includes keyboard 18 and screen 20.

In this embodiment, as will be seen from FIGS. 2 and 3, lap-top computer 16 contains the intelligent element of the connecting means, rather than display table 12, for connecting lap-top computer 16 to display table 12.

As seen in FIG. 1, screen 20 shows instructions 22, at this stage reading "Please Enter Purchase Code". Lap-top computer 16 which is being offered for sale can be touched and inspected closely by a prospective purchaser while still being secured to display table 12, as explained with reference to FIGS. 2 and 2A.

Formed in base 24 of lap-top computer 16 is one or more (preferably four) of connecting means 26. As can best be seen in FIG. 2A, connection means 26 has, formed in base 24, two concentric grooves 28 and 30. Groove 28 is of constant cross-section and contains locking element 32. Groove 30 has a wide part 34 and a narrow opening 36. Wall 38, which is located between groove 28 and groove 30 and which defines the wide part 34 and the narrow part 36 of groove 30, is of relatively resilient material. This material may be the same as that of the remainder of base 24 or the remainder of base 24 may be made of less resilient material than wall 38.

Screwed into display table 12 is connecting retainer 40 which includes rim 42, which in turn fits into and is retained by wide part 34 of groove 30. As can be seen in FIG. 2A, while locking element 32 remains in the position illustrated in FIG. 2A, wall 38 is biased towards groove 30 and connecting retainer 40 is retained in groove 30.

Figure 4:
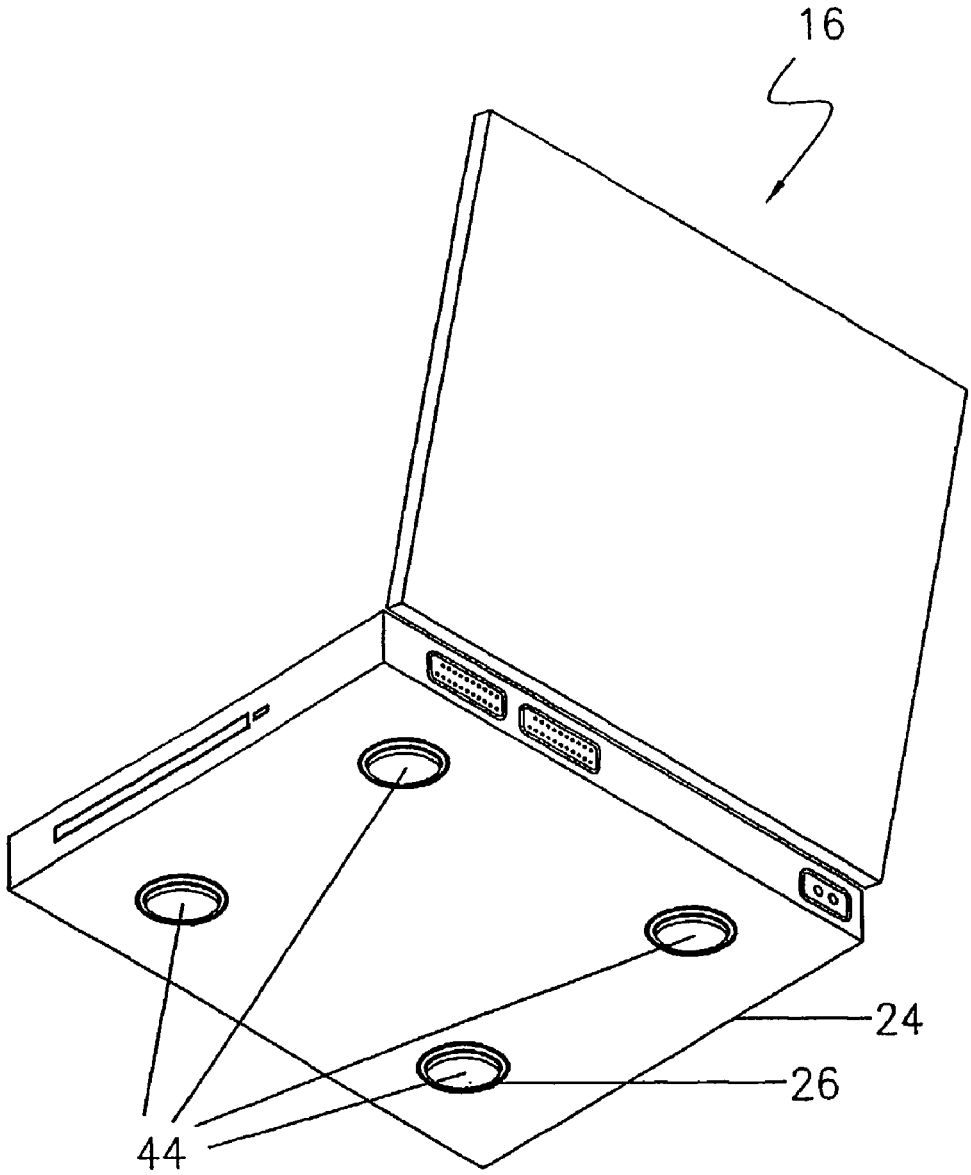
FIG. 4 is a perspective view from below of the lap-top computer shown in FIGS. 1 to 3.

An appropriate signal (discussed in further detail below) given to connecting means 26 will cause locking element 32 to move upwardly in groove 28 to the position shown in FIG. 3A. In this configuration, wall 38 is free to flex towards groove 28, thus freeing rim 42 of connecting retainer 40 and releasing lap-top computer 16 from display table 12 as shown in FIG. 3. Portion 44, which fits within connecting retainer 40 in the closed position, forms a foot for lap-top computer 16 once lap-top computer 16 has been released from display table 12. As can be seen from FIG. 4, base 24 of lap-top computer 16 has four such feet 44, each located within connecting means 26.

As will be recalled, in FIG. 1, screen 20 contained instructions 22 inviting the entry of a purchase code. A purchase code may be entered by a sales assistant when a customer has purchased lap-top computer 16 or by the customer, to whom the purchase code is given once the purchase transaction has been approved. The purchase code may be entered in various ways. For example, the code may be simply typed into keyboard 18. As another example, the purchase code may be beamed from another piece of hardware, such as a mobile phone or another suitable transmitting device. Transmission may take place in various ways, such as by infrared transmission to an infrared port (not shown) on lap-top computer 16.

Figure 5:
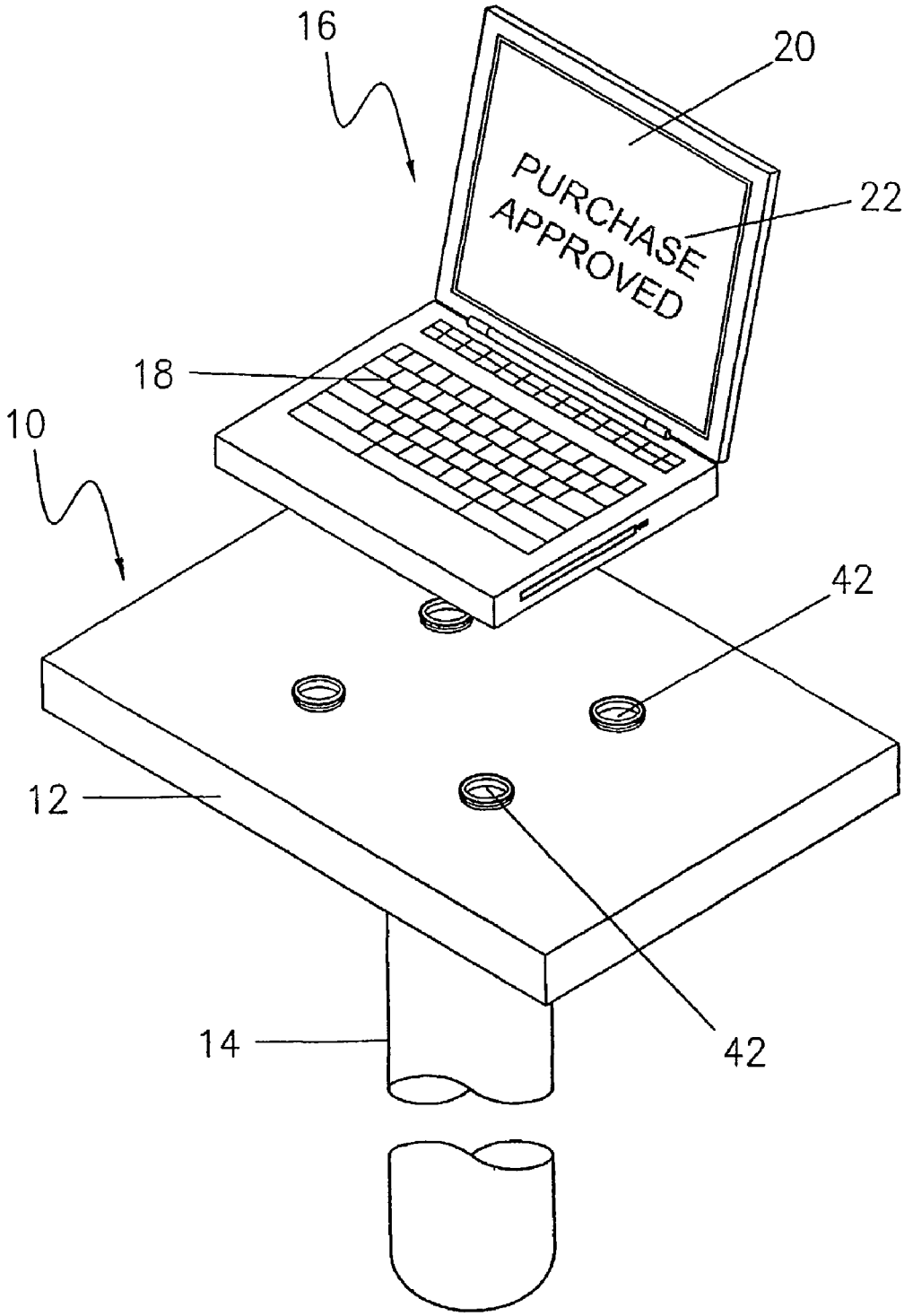
FIG. 5 is a perspective view of the display console of FIG. 1 after release of the lap-top computer.

When the correct code is entered, lap-top computer 16 is released from display table 12 as previously described and may show on screen 20 a different message or instruction 22, such as "Purchase Approved" (refer FIG. 5).

Figure 6:
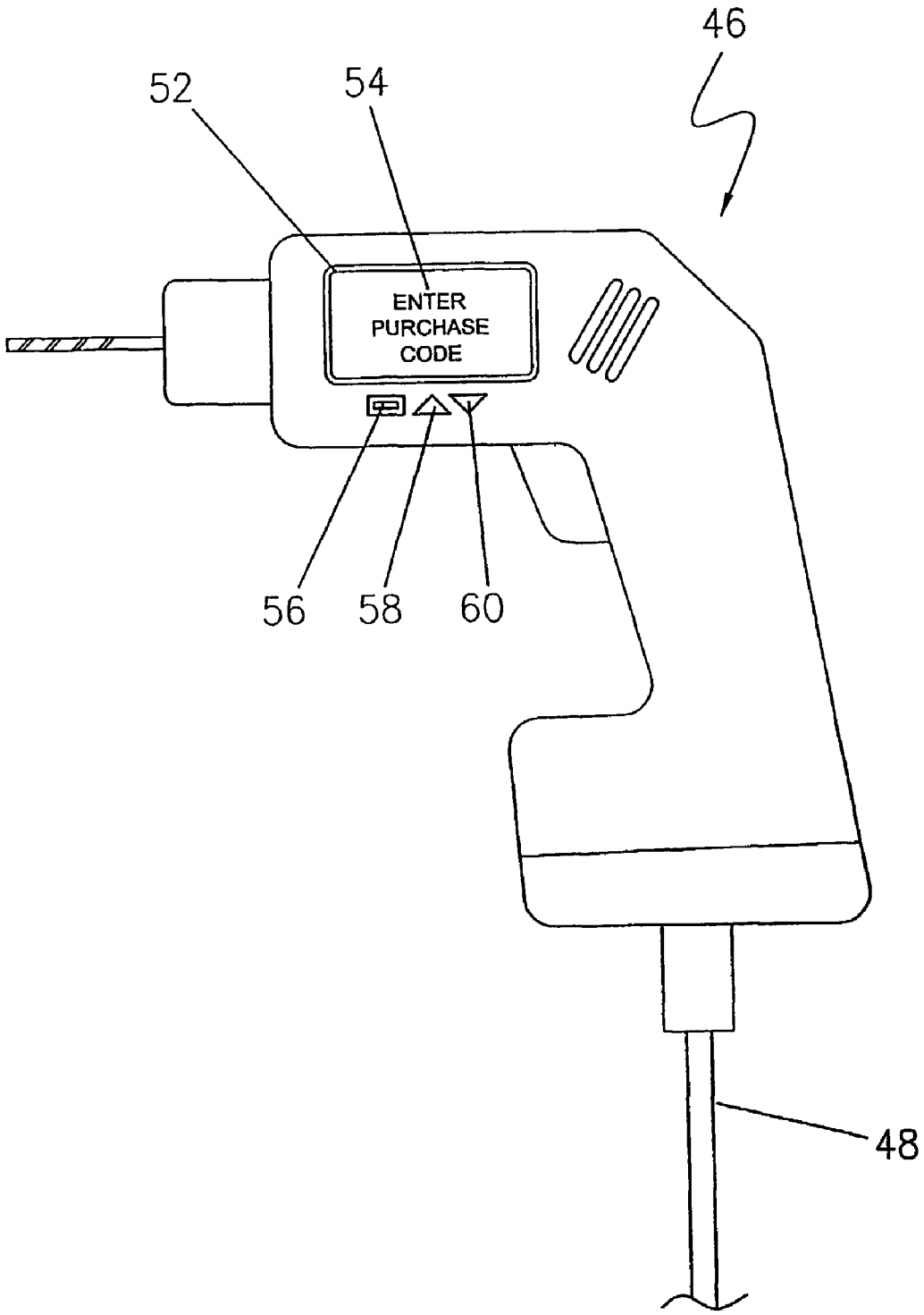
FIG. 6 is a side elevation of a power tool connected to a security cable, illustrating a second embodiment of the method of the invention.
Figure 7:
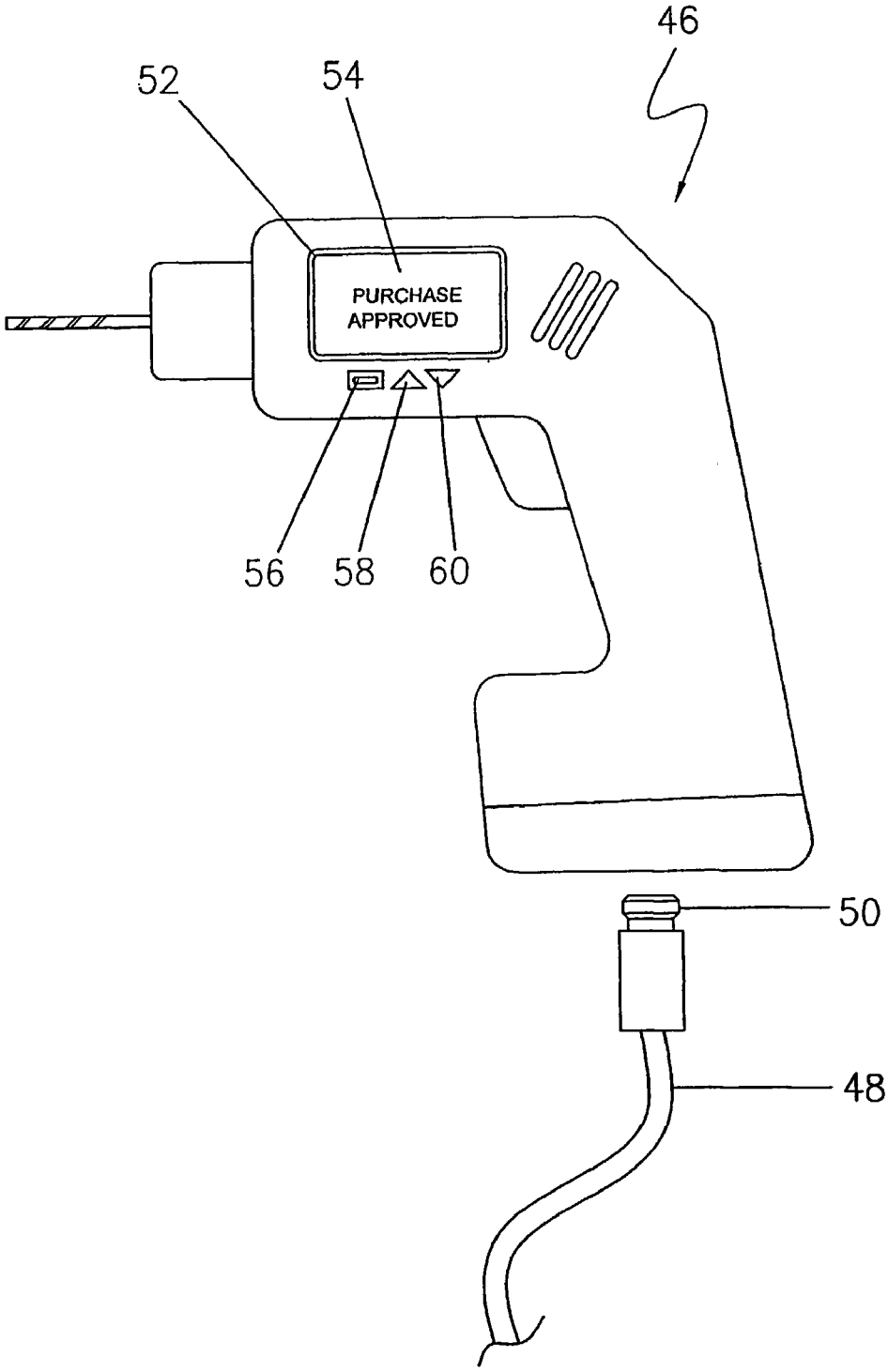
FIG. 7 is a side elevation of the power tool and cable of FIG. 6, after release of the connecting means.

Turning now to FIGS. 6 and 7, power tool 46 in this embodiment is connected to security cable 48, rather than to display table 12 as in the previous embodiment. This arrangement better suits the nature of the object in this embodiment (power tool 46). A prospective purchaser may wish to handle power tool 46, turning it around in his hands, for example. Lap-top computer 16, in the previous embodiment, can usually be adequately inspected while secured flat on display table 12.

As can be seen from FIG. 7, security cable 48 is attached to power tool 46 by connection means 50, which is of the "monkey grip" type illustrated in application No. PCT/AU99/00185. When an appropriate signal is given to connection means 50, connection means 50 is released from power tool 46. The manner of release can take place in various ways, some of which will now be described. Power tool 46 includes screen 52 containing instructions or message 54 and data entry buttons 56, 58 and 60. In a manner similar to that described for the previous embodiment, a purchase code may be entered, using buttons 56, 58 and 60, by a sales assistant or a purchaser, resulting in release of power tool 46 from security cable 48.

In an alternate arrangement, security cable 48 communicates with electronic equipment for "swiping" debit or credit cards. A prospective purchaser may swipe his or her card on the electronic equipment (not shown) and this may immediately result in release of security cable 48 from power tool 46. In a slightly different arrangement, after swiping of the card, the prospective purchaser may have the option of confirming or cancelling the sale, for example by pressing button 58 to confirm the sale and button 60 to cancel it. In that circumstance, security cable 48 would release from power tool 46 only after confirmation via button 58.

The embodiment in FIGS. 8 to 14 is especially suitable in connection with the purchase of duty free objects at airport terminals.

In accordance with the invention, a duty free "shop" may be set up in an airport terminal, without the need for any onsite personnel to assist in sales or processing payment. Such a "shop" would be available to travellers on a 24 hour a day basis.

Figure 8:
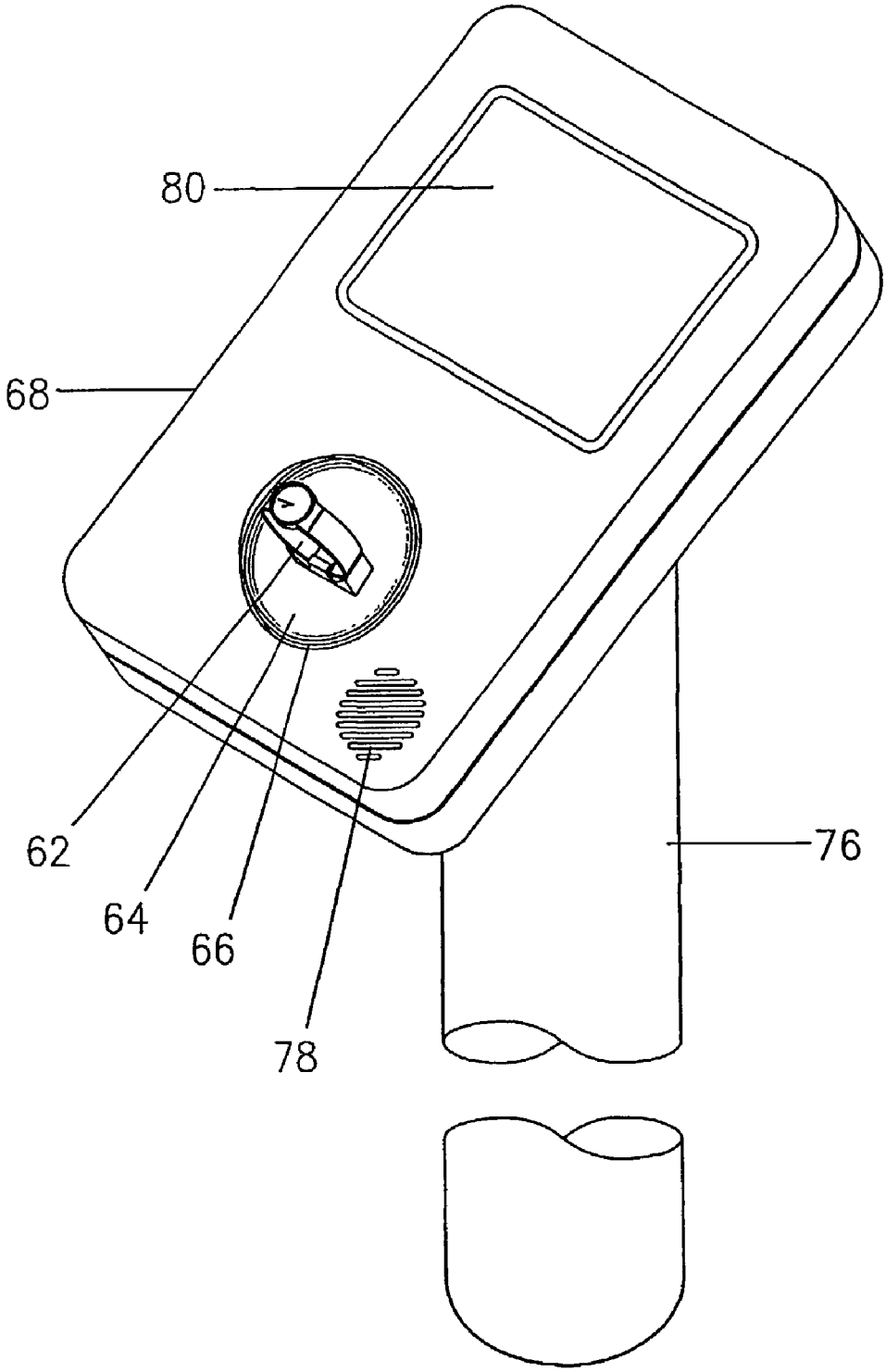
FIG. 8 is a perspective view of a sales console incorporating a first embodiment of the packaging of the invention connected to the console and operable according to a third embodiment of the method of the invention.
Figure 9:
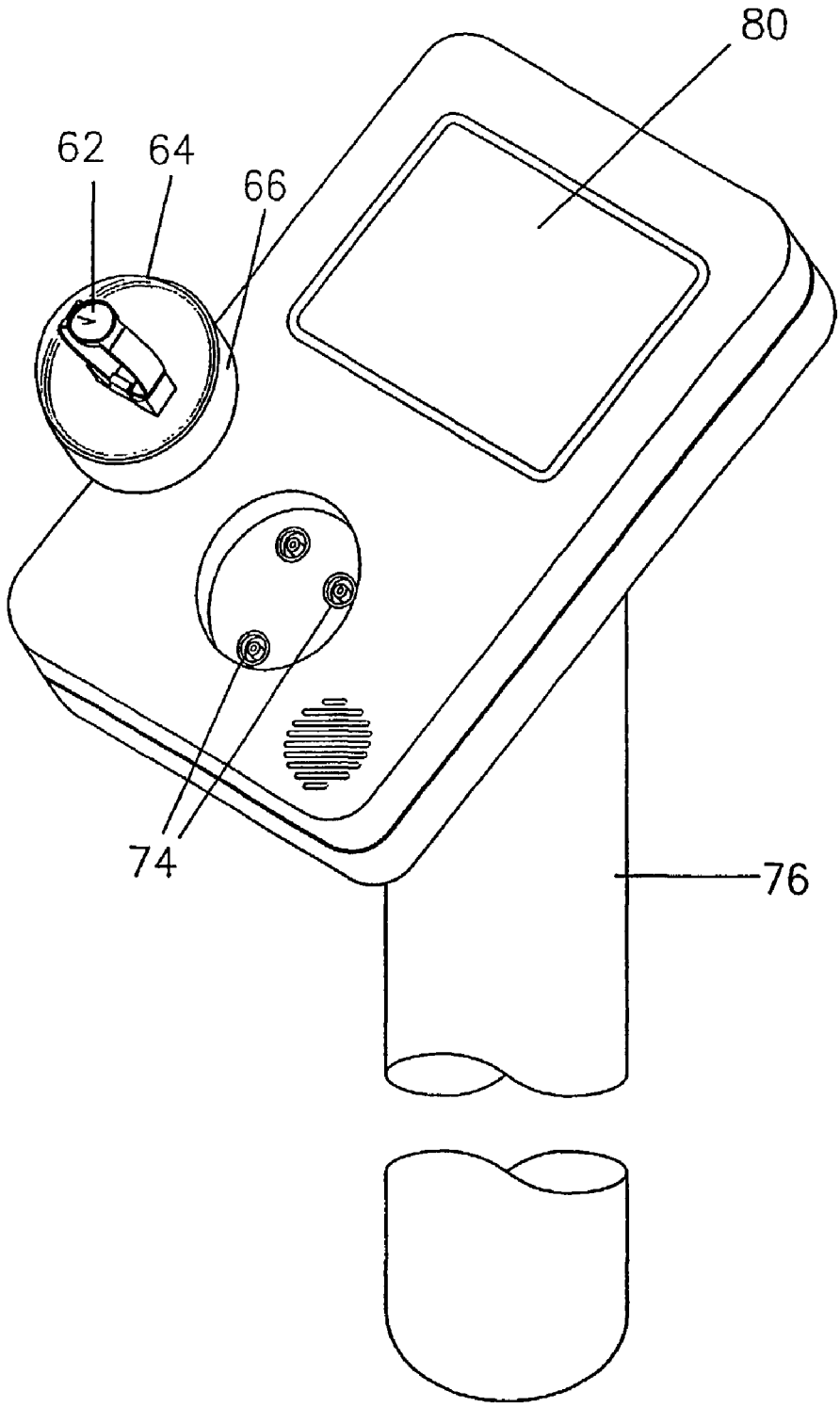
FIG. 9 shows the console of FIG. 8 after release of the packaging from the console and illustrates a first version of connecting means for this embodiment.
Figure 9A:
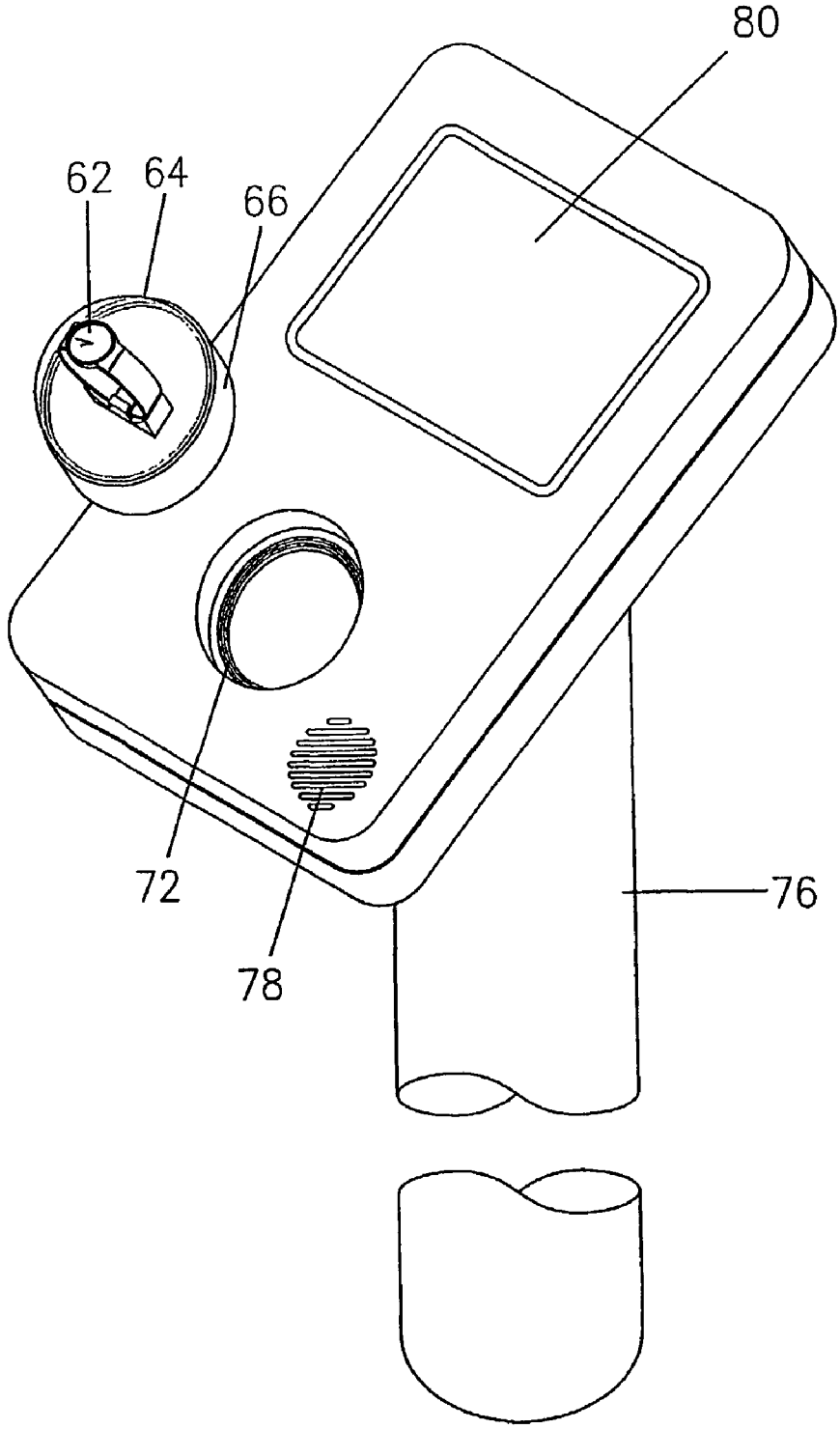
FIG. 9A is the same view as FIG. 9 except it shows a second version of the connecting means for this embodiment.
Figure 10:
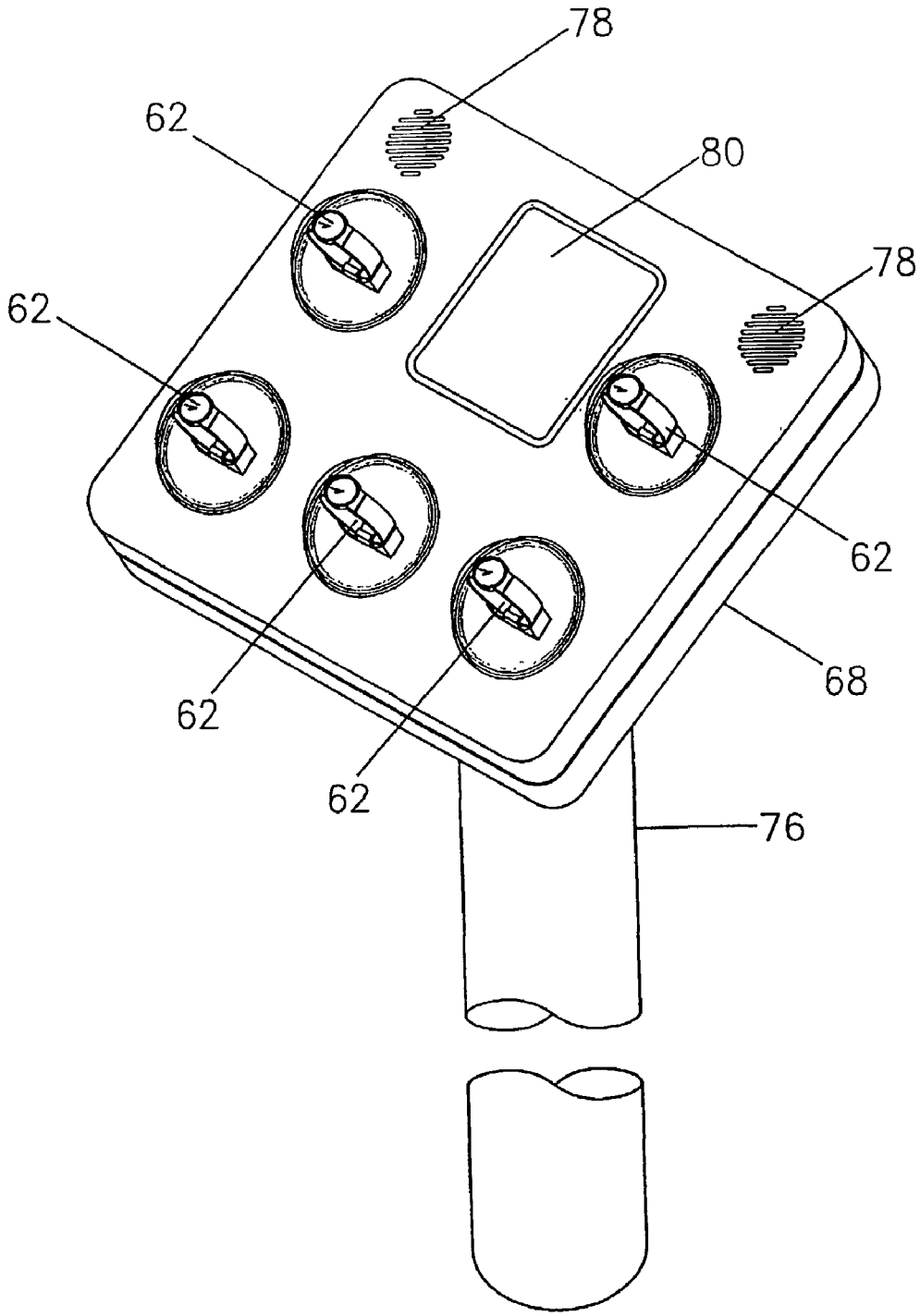
FIG. 10 is a perspective view of a sales console similar to that of FIG. 8 but having provision for multiple packaging and objects.
Figure 11:
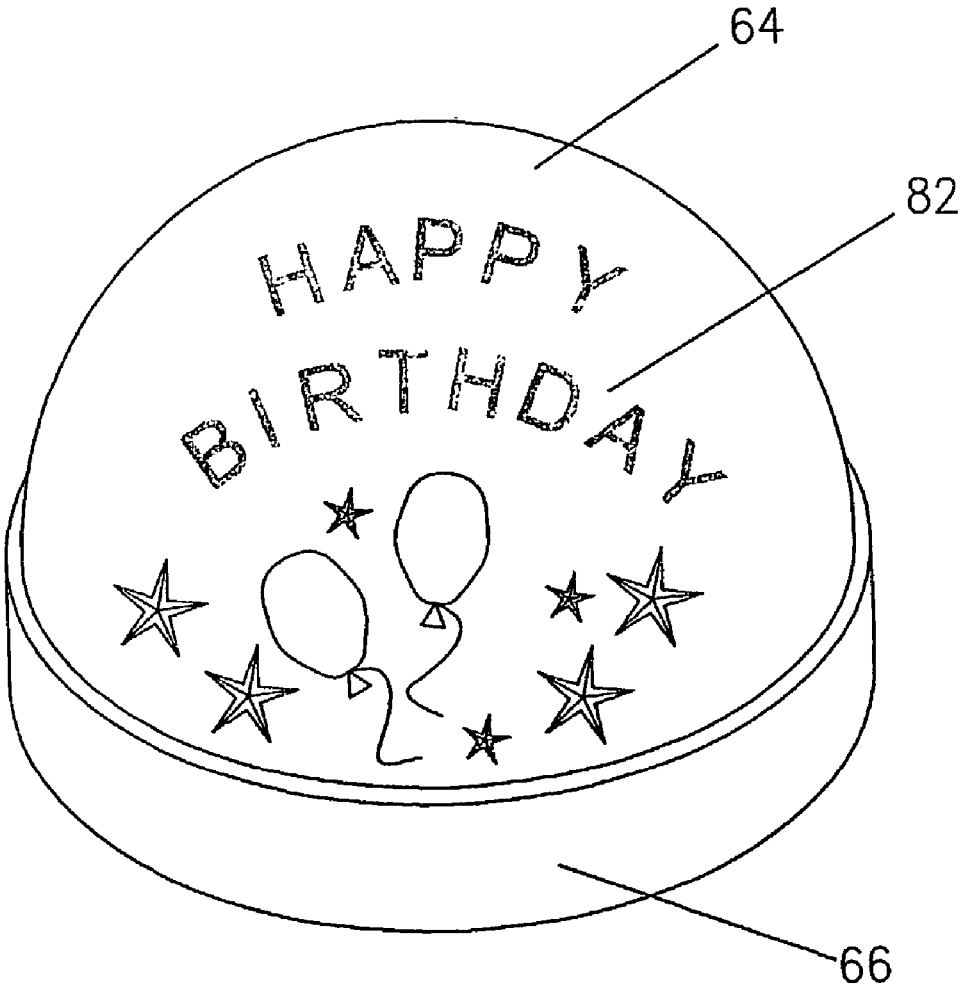
FIG. 11 is a perspective view of the packaging in FIGS. 8 to 10, showing a previously transparent dome in obscured mode, carrying decoration and a greeting.

Referring first to FIG. 8, wristwatch 62 is enclosed in normally transparent dome 64 attached to base 66 (refer FIG. 9), which in turn is attached to sales console 68. Sales console 68 may also provide the attachment means for other packages of a similar or different nature (refer, for example, to FIG. 10). Sales console 68 is supported on plinth 76 which may carry desired cables and connections for sales console 68.

In this embodiment, transparent dome 64 is attached to base 66 by connecting means 70 (refer FIG. 12) capable of release by remote activation. These are of an "intelligent obedient" nature, as discussed in International patent application No. PCT/AU99/00185. Base 66 is itself attached to sales console 68 by further connecting means, either perimeter strip connecting means 72 or point connecting means 74 capable of release by remote activation. The connection between dome 64 and base 66 provides the packaging for the wristwatch and, after the relevant transaction has been completed, the customer can carry away this package. The connection between base 66 and sales console 68 is for security purposes, so that the wristwatch will remain in the "shop" until an appropriate transaction has been completed.

To service customer enquiries and to process transactions, there is access to a sales enabler (not shown), who will normally be situated in a central area remote from the "shop". Such centralised sales enablers can service a significant number of the types of "shop" under discussion.

The access to the sales enabler can take place by any desirable means; in this example, the access is by telephone—either wired or mobile. The wired telephone can be provided in the "shop". The mobile telephone will normally be the customer's own telephone. In the case of the wired telephone, there may be a direct link to the sales enabler or a telephone number, such as a toll free number, displayed in the appropriate place. In the case of access via a mobile phone, a toll free number will normally be provided.

(Another method of access may be via the Internet, with a computer terminal being provided in the "shop". The operation of this will be apparent to one skilled in the art.)

The direct link to the sales enabler or the toll free number to be called may be a general number or may be specific to the actual object or type of object in which the customer is interested.

Although it is possible to operate the vending method of the invention by using an automated system with various menus, it is an option that a live sales enabler is accessible. In this way, the customer can make enquiries as to the nature of the object and its suitability for the customer's intended purpose. The sales enabler can also guide the customer towards another object if the first choice turns out to be unsuitable.

In addition to or instead of access to a live sales enabler, sales console 68 can include speaker 78 and screen 80, by means of which a prospective purchaser can be informed about the object (in this case, wristwatch 62). Display on screen 80 and commencement of a recording via speaker 78 may be activated by proximity of a prospective purchaser, or by preliminary swiping of a credit or debit card, or by some other means.

Once the customer has decided to purchase a selected object, the customer in effect makes an offer to purchase the object. The sales enabler can process payment for the object in an appropriate way. For example, the sales enabler can accept authorisation to debit a credit or debit card of the customer, or funds can be transferred by the EFTPOS system. Other suitable sales transaction methods may be used.

At this stage, if appropriate, the customer may request that the package be "wrapped". This can be effected by some of the methods already disclosed above. Another way of "wrapping" the package can lie in causing dome 64 to fluoresce or be otherwise activated so that wristwatch 62 can no longer be seen. A message of greeting 82 may be incorporated in dome 64, in this case, "Happy Birthday". The sales enabler can activate these features by communicating with dome 64 which contains appropriate receptors (not shown). Communication can take place by any suitable means but conveniently may be by telephone.

Figure 13:
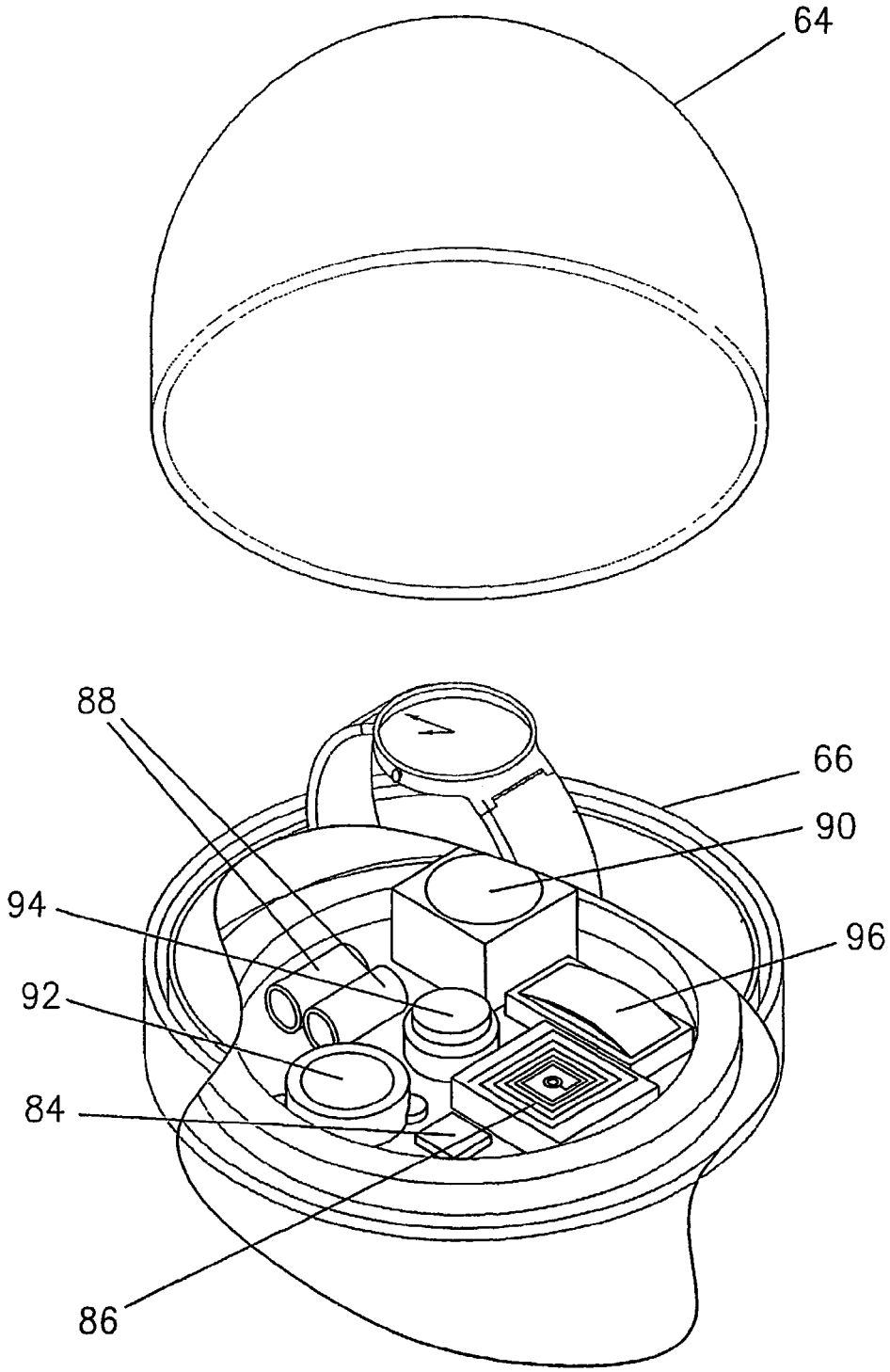
FIG. 13 is a perspective view of the packaging of FIGS. 8 to 12, showing by way of example modules, chips, etc., located in the base of the packaging.

In addition, the sales enabler may program the connecting means in the package to open on a selected date, such as on a birthday. Refer to FIG. 13, where clock chip 84, command module 86 and batteries 88 are provided for this purpose. GPS (Global Positioning by Satellite) module 90 is provided to enable "tracking" of base 66 or to ensure that dome 64 is not released from base 66 until base 66 reaches a desired location or leaves a chosen area. Speaker 92 and infrared reader 94 are shown in this embodiment by way of example of inclusion of hardware to carry out the various abilities of the packaging of the invention as already described. Display module 96 is adapted, when activated, to cause dome 64 to fluoresce and to display the desired message 82.

When the sales transaction is completed, the sales enabler can send a signal (for example by telephone) to connecting means 72 or 74 so that connecting means 72 or 74 (holding base 66 to sales console 68) releases.

To help detect unauthorised detachment of base 66 from sales console 68, base 66 may also include sensors (e.g. infrared reader 94) for signals generated at appropriate places of the airport perimeter. Such sensors may be neutralised when the sales enabler signals connecting means 72 or 74 to release. If such signal is not received, the sensors will remain active and an alarm will sound when base 66 passes the security points.

As already mentioned, base 66 may also incorporate means trackable by a global positioning system via GPS module 90, so that base 66 may be tracked in the case of theft or for other purposes, such as inventory or input of demographic information.

Figure 12:
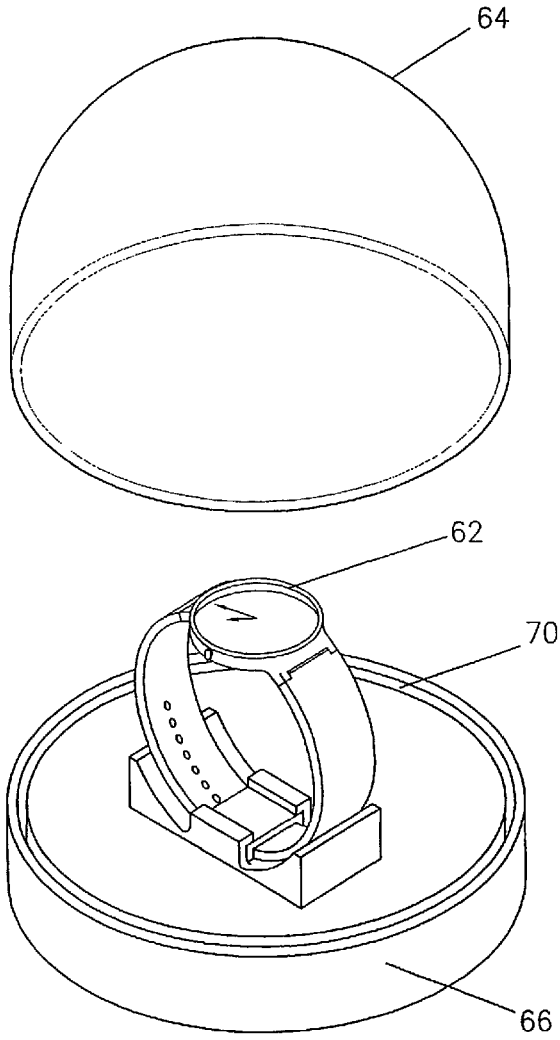
FIG. 12 is a perspective view of the packaging of FIGS. 8 to 11, after release of connecting means holding the packaging together.

While wristwatch 62 can be released from dome 64 and base 66 as shown in FIG. 12 by deactivating connecting means 70 (either by immediate deactivation or by programmed deactivation as already discussed), it is to be appreciated that connecting means 70 may optionally be released at the same time as connecting means 72 or 74.

Figure 14:
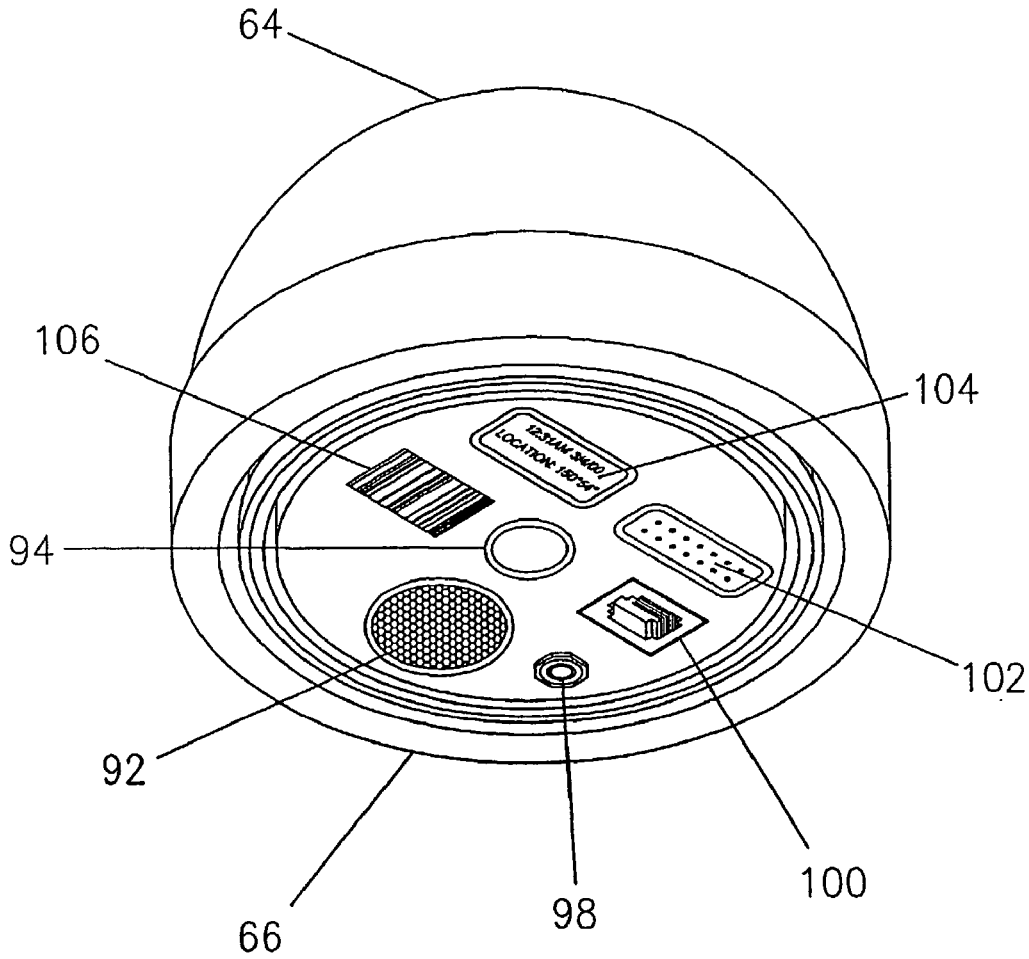
FIG. 14 is a perspective view from below of the packaging of FIG. 12.

The contents of FIG. 13 have been described above. The underneath of base 66 as shown in FIG. 14 shows speaker 92, IR reader 94, data jack 98, telephone port 100 and serial port 102, as well as LCD display 104 and bar code 106. Bar code 106 may be updatable by the vendor.

During or after the transaction, the customer may be given the opportunity to enter a game of chance for a displayed prize. This may be facilitated by the sales enabler or by direct interaction with packaging of the invention used for the prize or for the object. Alternately, the game of chance itself may be the transaction, the customer making an offer to "purchase" the game by paying an entry fee. The invention also covers this aspect.

Figure 15:
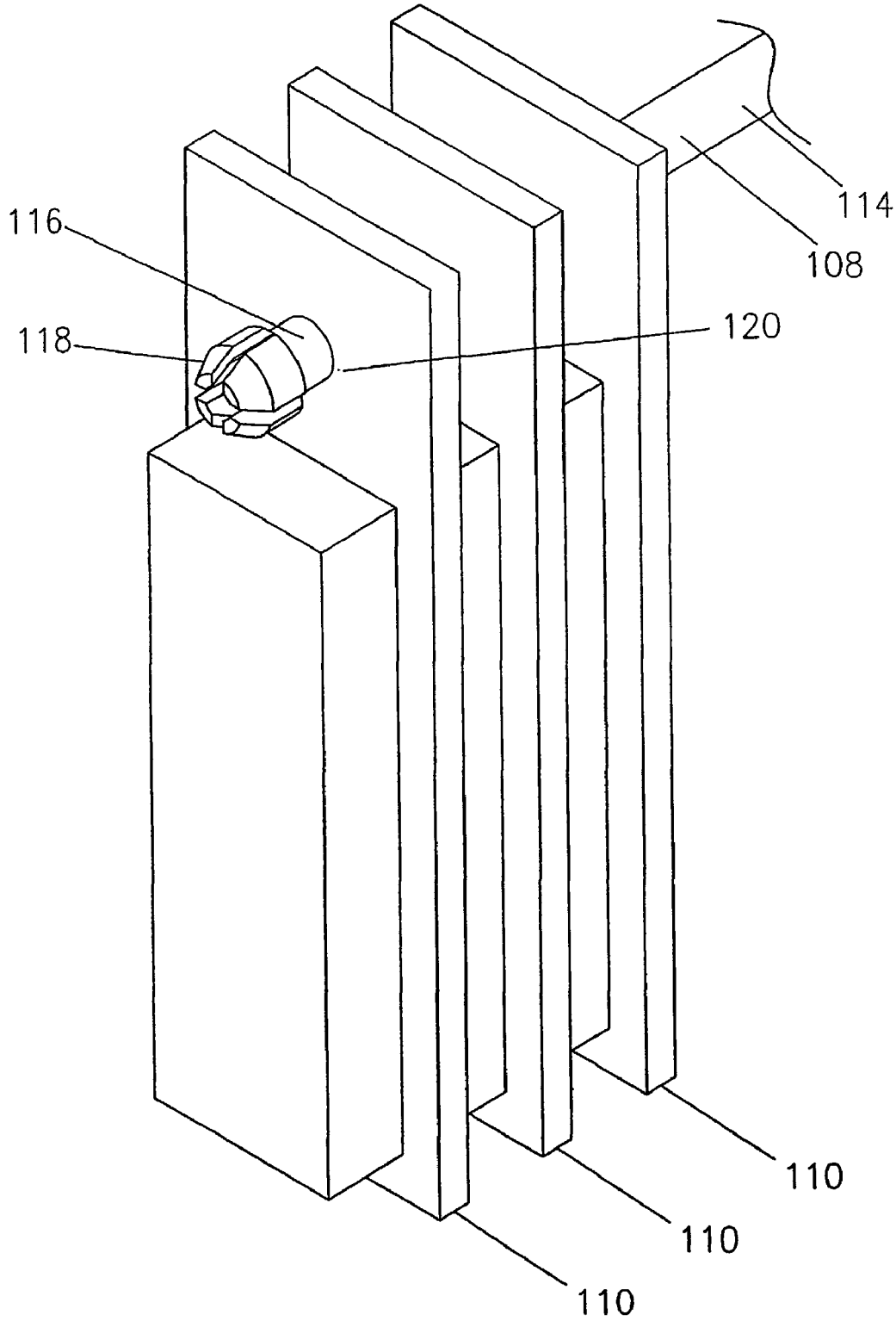
FIG. 15 is a perspective view of a sales hanger illustrating a second embodiment of packaging of the invention and operable according to a fourth embodiment of the method of the invention.
Figure 16:
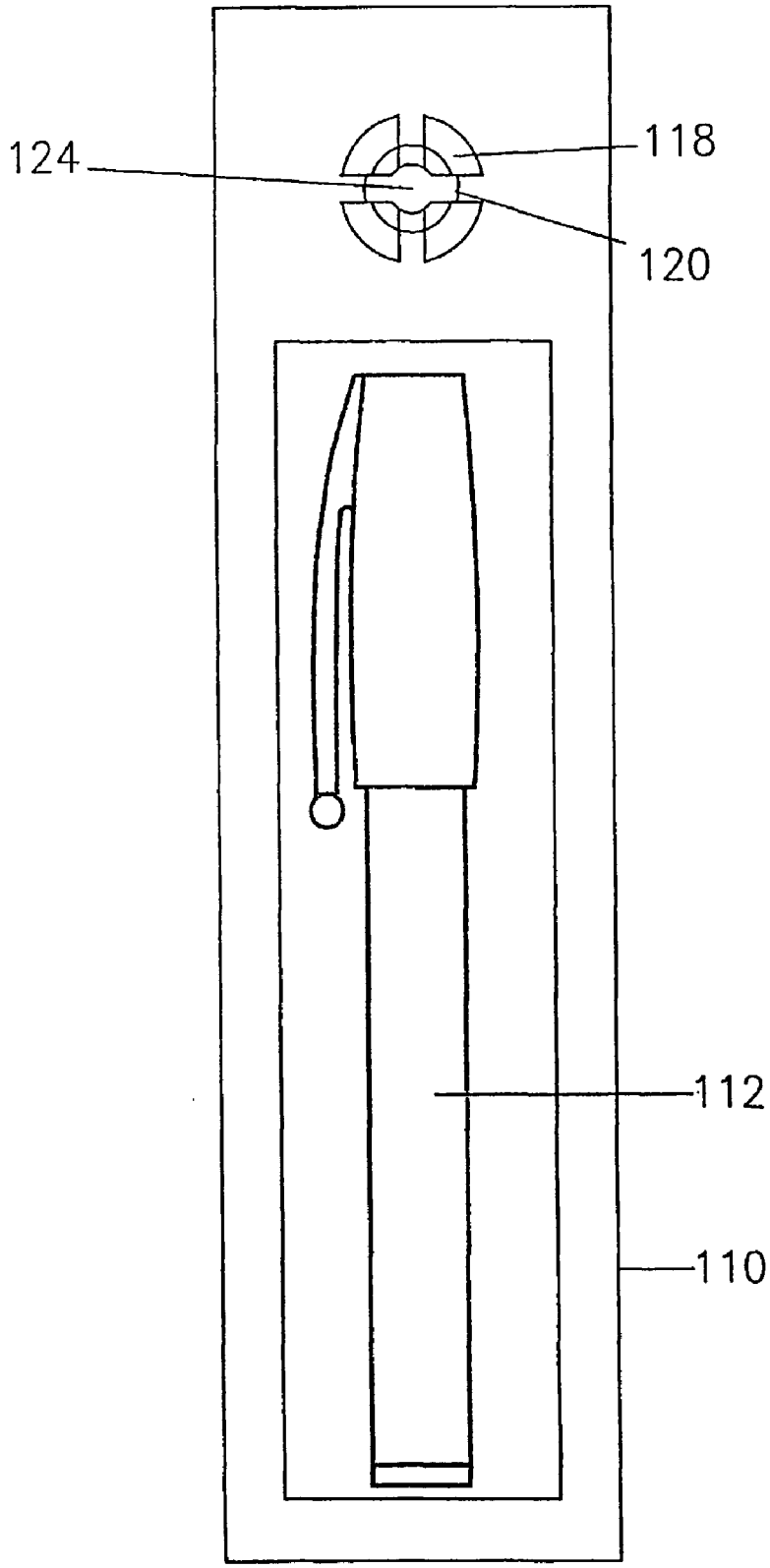
FIG. 16 is a front elevation of the sales hanger and packaging of FIG. 15.
Figure 17:
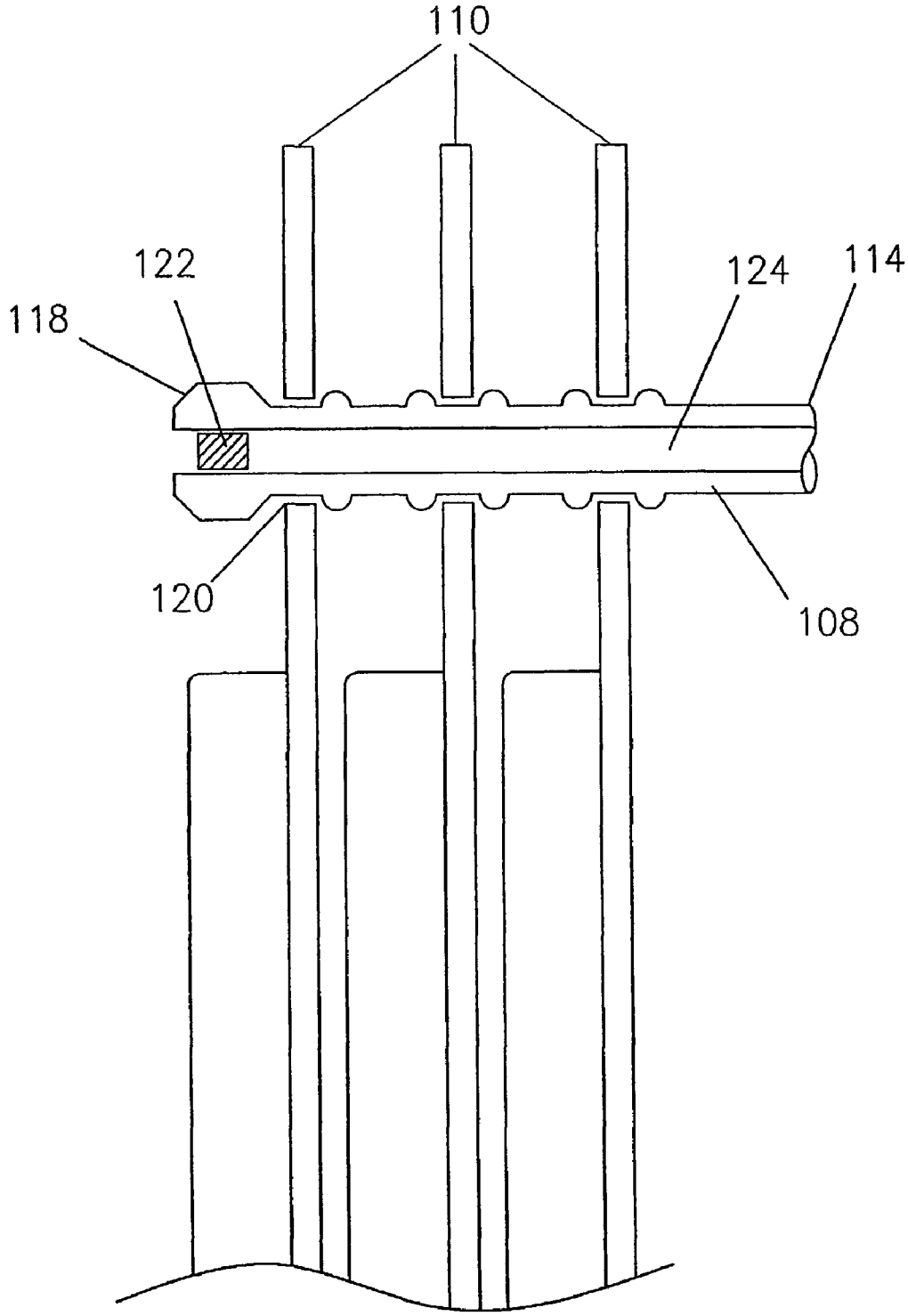
FIG. 17 is a side elevation, partly cross-sectional, of the sales hanger and packaging of FIGS. 15 and 16.

Turning now to FIGS. 15 to 17, "smart" hanger 108 is shown having mounted on it a plurality of packages 110, each containing an object 112 (see FIG. 16), in this case a pen.

Hanger 108 is fixed at end 114 to a wall or other fitting, so that packages 110 cannot be removed from end 114.

Hanger 108 has at other end 116 flared portion 118. Aperture 120 of package 110 is too small to permit flared portion 118 to pass through, at least when flared portion 118 is held in expanded mode by locking element 122 (refer FIG. 17).

Locking element 122 can be caused to retreat from flared portion 118 along channel 124 when activated by suitable means, such as those disclosed in application No. PCT/AU99/00185. Activation may take place after a customer has "swiped" a debit or credit card, for example. Thereupon, locking element 122 retreats from flared portion 118, enabling flared portion 118 to compress and permitting the package 110 closest to flared portion 118 to be removed from hanger 108. Locking element 122 then moves back to its initial position to hold flared portion 118 in expanded mode, to prevent the next package 110 from being removed from hanger 108.

INDUSTRIAL APPLICABILITY

It will be apparent to one skilled in the art that the various methods and packaging disclosed herein are capable of radically changing the way in which vending is carried out and objects are secured. As opposed to Internet shopping where the customer can view only a picture of the object, in the case of the methods of the present invention, the object can be viewed in real life. Further, the packaging may be designed so that the object can be touched while still being secured within the packaging elements, which may have openings or be openable for this purpose.

Even in the case of supermarkets, the objects can be released from the shelf using the methods of the invention, the transaction having already been complete at that stage (eg., by swiping a card), there being no need for cashiers or check out operators.

Another advantage of the methods and packaging of this invention is the ability to know the exact stock position, in real time, at any point. Replacement stock can be ordered efficiently and without delay. Traditional inventory systems would not be required.

Moreover, if the object is loaded into the packaging of the invention at the point of manufacture, and can be tracked via a global positioning system or similar means, an audit trail can be established. This can have advantages in many ways for example, to identify genuine objects, to ensure correct quarantine procedures and to facilitate customs issues. For instance, such objects may be cleared for export from one country and for importing into another, at the export point or even earlier, using the tracking feature built into the packaging of the invention.

The invention claimed is:

1. A method of controlling access to an object, the method including the steps of securing the object or a packaging thereof by use of connecting means which connect the object or the packaging to a security means, the connecting means being capable of release by a chosen external or internal signal upon provision of a trigger; and releasing the connecting means by providing the chosen signal upon provision of the trigger, wherein the trigger is chosen from the group consisting of a predetermined period of time or calendar date, movement of the object or the packaging to a chosen location and proximity of the object to an authorized item.

2. The method of claim 1, wherein the packaging of the object is secured by use of the connecting means.

3. The method of claim 2, wherein the signal is an internal signal and the trigger is expiration of a predetermined period of time.

4. The method of claim 3, wherein the object is a pharmaceutical object or a perishable foodstuff.

5. The method of claim 1, wherein the signal is an external signal and the trigger is proximity of an authorized item.

6. The method of claim 5, wherein the authorized item is a service manual.

7. The method of claim 1, wherein the chosen location is outside a chosen area.

8. The method of claim 7, wherein the signal is provided using global positioning technology.

9. The method of claim 1, wherein the security means is chosen from the group consisting of a sales console, a security cable and a sales hanger.

10. The method of claim 1, wherein the connecting means is capable of release by remote activation and the signal is provided by remote activation means.

11. A security vending system for carrying out the method of claim 1, the system including the security means and the connecting means capable of release by a chosen external or internal signal.

12. The system of claim 11, wherein the connecting means has an intelligent element adapted to receive the chosen signal and the intelligent element resides in the security means.

13. The system of claim 11, wherein the connecting means has an intelligent element adapted to receive the chosen signal and the intelligent element resides in the object.

14. The system of claim 11, wherein the connecting means has a plurality of intelligent elements, at least one of which resides in the security means and at least one of which resides in the object.

15. The system of claim 14, wherein the connecting means has an intelligent element adapted to receive the chosen signal and the intelligent element resides in the security means.

16. The system of claim 14, wherein the connecting means has an intelligent element adapted to receive the chosen signal and the intelligent element resides in the object.

17. The system of claim 14, wherein the connecting means has a plurality of intelligent elements, at least one of which resides in the security means and at least one of which resides in the object.

18. The system of claims 11, wherein the security means is a sales console adapted to secure one or more of the objects or their packages.

19. The system of claim 11, wherein the security means is a security cable or sales hanger.

20. A method of vending an object, the method including the steps of securing the object or a packaging thereof by use of connecting means which connect the object or the packaging to a security means, wherein the connecting means includes a passageway having walls at least one of which is resilient, and a locking means being disposed in the passageway and being movable between a locked position and an unlocked position, the locking means being adapted to hold apart the walls when the locking means is in the locked position and to permit deflection of at least one of the walls when in the unlocked position, the connecting means being capable of release by remote activation, accepting an offer to purchase the object, and releasing the connecting means by activating remote activation means.

21. The method of claim 20, wherein the object is enclosed in one or more packaging elements and is secured within the packaging element or elements by the connecting means.

22. The method of claim 21, wherein at least one packaging element is adapted to enable viewing of the object while enclosed in the one or more packaging elements, the method including the additional step of obscuring the at least one packaging element to prevent viewing of the object enclosed in the one or more packaging elements.

23. The method of claim 22, wherein the at least one packaging element includes transparent material capable of changing to a non transparent state and the obscuring step is carried out by activating change of the transparent material to the non transparent state.

24. The method of claim 22, wherein the at least one packaging element includes a confined element capable of expansion and the obscuring step is carried out by causing the confined element to expand.

25. The method of claim 21, wherein the object is secured within the one or more packaging elements by further connecting means and the packaging element is locked to the security means by the connecting means capable of release by remote activation, the further connecting means being adapted to continue to secure the object within the one or more packaging elements despite release of the connecting means, the method including the further step of releasing the further connecting means to expose the object.

26. The method of claim 25, wherein the further connecting means are released by a command programmed into the one or more packaging elements.

27. The method of claim 26, wherein the command is chosen from the group consisting of reception of a spoken command, expiration of a chosen period of time and positioning of the further connecting means at a chosen location or outside a chosen area.

28. The method of claim 20, wherein the security means is chosen from the group consisting of a sales console, a security cable and a sales hanger.

29. The method of claim 20, wherein the offer to purchase is conveyed by telephone, by Internet communication, or by a combination thereof.

30. The method of claim 20, wherein the connecting means are released by remote activation means chosen from the group consisting of input of a password, electric current, an electronic signal, a magnetic force, an electromagnetic force, electromagnetic induction, a radio signal, an infra red signal and high frequency heating.

31. The method of claim 20, wherein the step of releasing the connecting means is caused to occur on a chosen date or at a chosen location.

32. The method of claim 20, wherein the object is a game of chance.

33. A security vending system for carrying out the method of claim 20, including a security means and the connecting means capable of release by remote activation.

34. Packaging for an object, the packaging including one or more packaging elements and connecting means adapted to secure the object in the packaging element or elements, wherein the connecting means includes a passageway having walls at least one of which is resilient, and a locking means being disposed in the passageway and being movable between a locked position and an unlocked position, the locking means being adapted to hold apart the walls when the locking means is in the locked position and to permit deflection of at least one of the walls when in the unlocked position, the connecting means being capable of release by remote activation.

35. The packaging of claim 34, wherein the packaging element or elements are adapted to enclose the object.

36. The packaging of claim 35, wherein the connecting means are adapted to secure the object in the packaging element or elements by connecting the packaging element or elements to the packaging element itself or the packaging elements themselves, respectively, or by connecting one packaging element to another packaging element.

37. The packaging of claim 35, wherein the connecting means are adapted to secure the object in the packaging element or elements by connecting the packaging element or elements to a security means.

38. The packaging of claim 34, wherein the connecting means are adapted to release by remote activation chosen from the group consisting of input of a password, electric current, an electronic signal, a magnetic force, an electromagnetic force, electromagnetic induction, a radio signal, an infra red signal and high frequency heating.

39. The packaging of claim 34, wherein at least one packaging element is adapted to enable viewing of the object while enclosed in the one or more packaging elements and the at least one packaging element is adapted to be obscured to prevent viewing of the object enclosed in the one or more packaging elements.

40. The packaging of claim 39, wherein the at least one packaging element includes transparent material capable of changing to a non transparent state by application of suitable means.

41. The packaging of claim 40, wherein the suitable means is an electric current.

42. The packaging of claim 40, wherein the suitable means causes the transparent material to fluoresce and thus become non transparent.

43. The packaging of claim 39, wherein the at least one packaging element includes a confined element adapted to expand and obscure the at least one packaging element.

44. The packaging of claim 34, which also includes means adapted to allow tracking of the packaging as to location thereof.

45. The packaging of claim 44, wherein the means adapted to allow tracking use global positioning by satellite technology.

46. The packaging of claim 34, which includes alarm activation means.

47. The packaging of claim 46, wherein the alarm activation means are adapted to activate an alarm if the packaging is moved beyond a chosen area without authorisation.

48. The packaging of claim 34, which also includes illumination means.

49. The packaging of claim 34, which includes activatable means adapted to provide information about the object upon activation.

50. The packaging of claim 49, wherein the activatable means is activated by a visual, audio, proximity or olfactory stimulus.

* * * * *